US009681753B1

(12) United States Patent
Rudolph

(10) Patent No.: US 9,681,753 B1
(45) Date of Patent: Jun. 20, 2017

(54) COMBINATION COOLER SUPPORT AND DRINK DISPLAY DEVICE

(71) Applicant: Keith Rudolph, Calvert City, KY (US)

(72) Inventor: Keith Rudolph, Calvert City, KY (US)

( * ) Notice: Subject to any disclaimer, the term of this patent is extended or adjusted under 35 U.S.C. 154(b) by 0 days.

(21) Appl. No.: 14/963,392

(22) Filed: Dec. 9, 2015

(51) Int. Cl.
*A47C 7/70* (2006.01)
*A47C 4/04* (2006.01)
*A47C 13/00* (2006.01)

(52) U.S. Cl.
CPC ..... *A47C 7/70* (2013.01); *A47C 4/04* (2013.01); *A47C 13/00* (2013.01)

(58) Field of Classification Search
CPC .. A47C 7/70; A47C 7/68; A47C 13/00; A47C 4/04
USPC ..... 297/173, 188.01, 35, 39
See application file for complete search history.

(56) References Cited

U.S. PATENT DOCUMENTS 624,812 A * 5/1899 Hunzinger ..... A47C 7/70 297/145
2,494,838 A * 1/1950 Slaughter ..... A47C 7/70 297/145
3,135,552 A * 6/1964 Lockshin ..... A47C 7/16 297/39
3,894,496 A * 7/1975 Phillips ..... A47C 7/68 108/50.11
5,458,395 A * 10/1995 Skarda, Jr. ..... A47C 13/00 297/173
6,017,085 A * 1/2000 LaCroix ..... A47C 7/70 16/343
6,082,813 A 7/2000 Chen
D484,003 S 12/2003 Bozych
6,851,748 B1 * 2/2005 Garrick ..... A47C 1/03 248/429
6,993,931 B1 2/2006 Hamilton
7,475,889 B2 1/2009 Marmah et al.
8,752,799 B2 6/2014 Johnson
8,882,064 B2 11/2014 Gregg, Jr. et al.
8,919,625 B1 * 12/2014 Pope ..... B62J 11/00 224/412
2006/0170255 A1 * 8/2006 Huang ..... A47D 1/02 297/39

* cited by examiner

*Primary Examiner* — Milton Nelson, Jr.

(57) ABSTRACT

A combination cooler support and drink display device combined with a cooler support includes a frame that comprises a pair of front legs and a pair of back legs. Each of a pair of beams is pivotally coupled to a respective front leg and a respective back leg. A platform, which is rigid, is pivotally coupled to each of the front legs and each of the back legs. The frame is foldable. With the frame unfolded, the pair of beams are coplanar and in substantial parallelism with the platform. Each of a pair of side tables has an inner edge hingedly coupled to a respective beam. Cup holders are positioned in the side tables. The platform is configured to support and position a cooler to dispense drinks into cups, and the cup holders are configured to store the cups prior to and after filling.

15 Claims, 5 Drawing Sheets

COMBINATION COOLER SUPPORT AND DRINK DISPLAY DEVICE

BACKGROUND OF THE DISCLOSURE

Field of the Disclosure

The disclosure relates to drink display devices and more particularly pertains to a new drink display device combined with a cooler support.

SUMMARY OF THE DISCLOSURE

An embodiment of the disclosure meets the needs presented above by generally comprising a frame that comprises a pair of front legs and a pair of back legs. Each of a pair of beams is pivotally coupled to a respective front leg and a respective back leg. A platform, which is rigid, is pivotally coupled to each of the front legs and each of the back legs. The frame is foldable. With the frame unfolded, the pair of beams are coplanar and in substantial parallelism with the platform. Each of a pair of side tables has an inner edge hingedly coupled to a respective beam. Cup holders are positioned in the side tables. The platform is configured to support and position a cooler to dispense drinks into cups, and the cup holders are configured to store the cups prior to and after filling.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
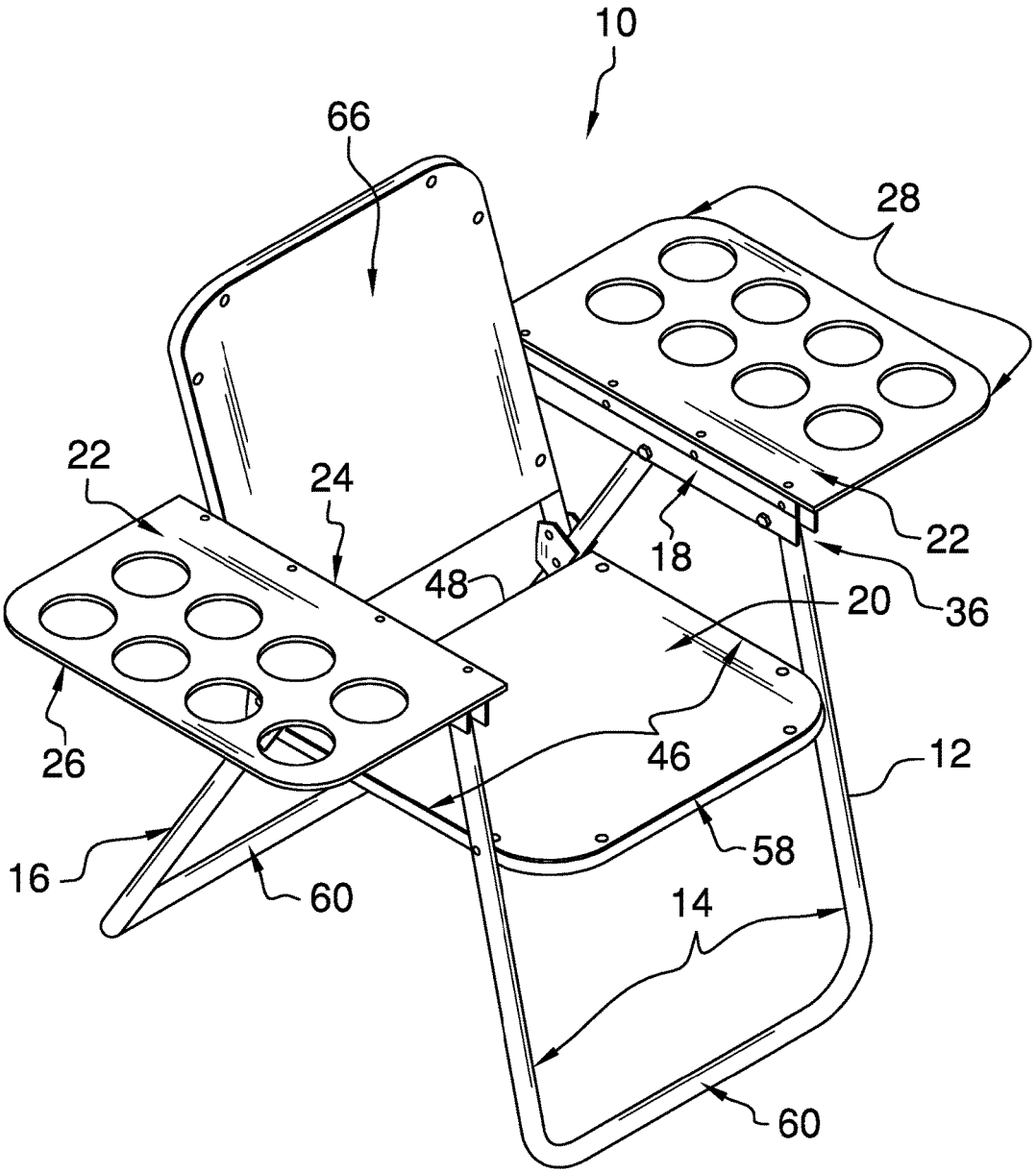
FIG. 1 is an isometric perspective view of a combination cooler support and drink display device according to an embodiment of the disclosure.
Figure 2:
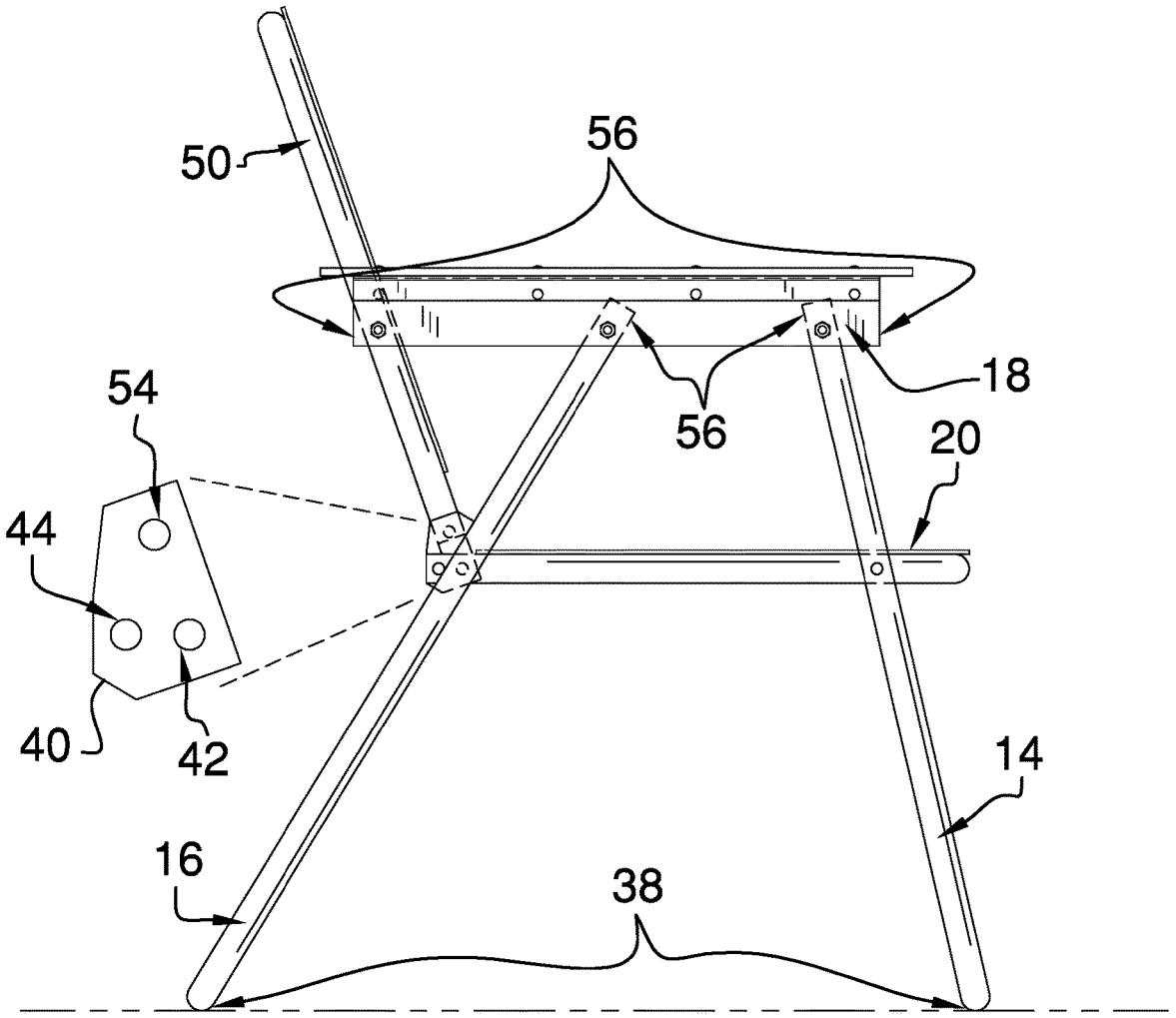
FIG. 2 is a side view of an embodiment of the disclosure.
Figure 3:
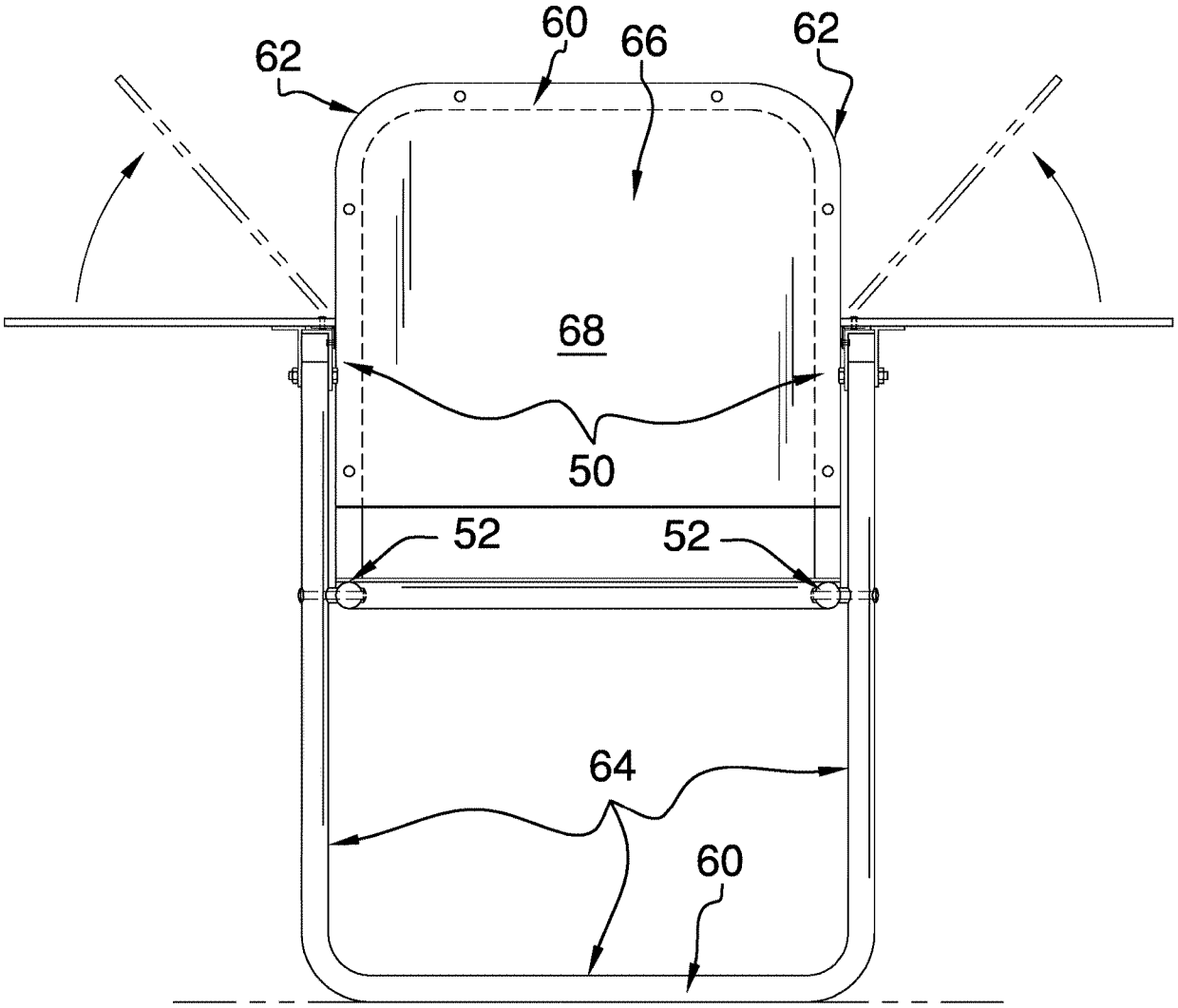
FIG. 3 is a front view of an embodiment of the disclosure.
Figure 4:
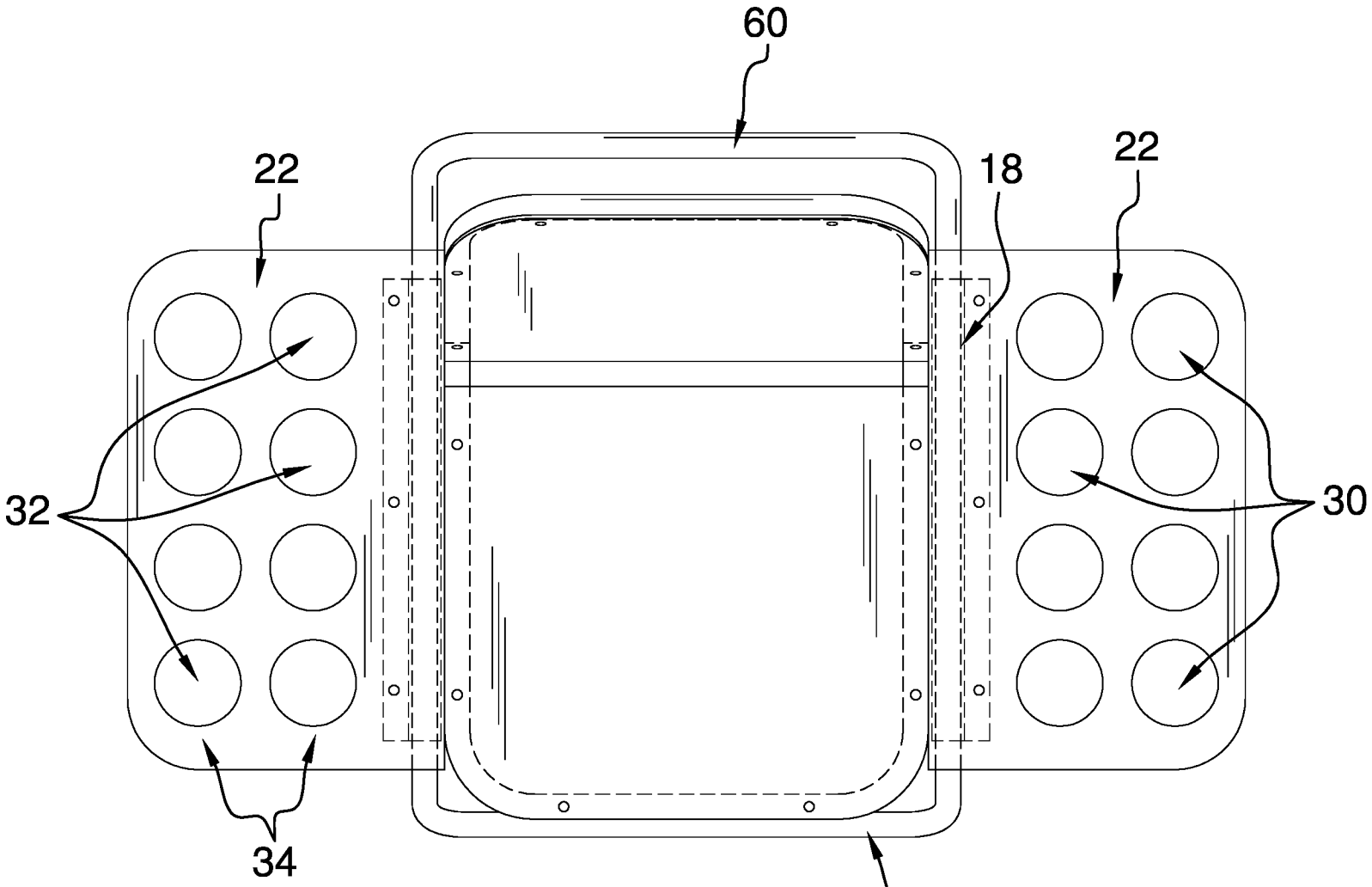
FIG. 4 is a top view of an embodiment of the disclosure.
Figure 5:
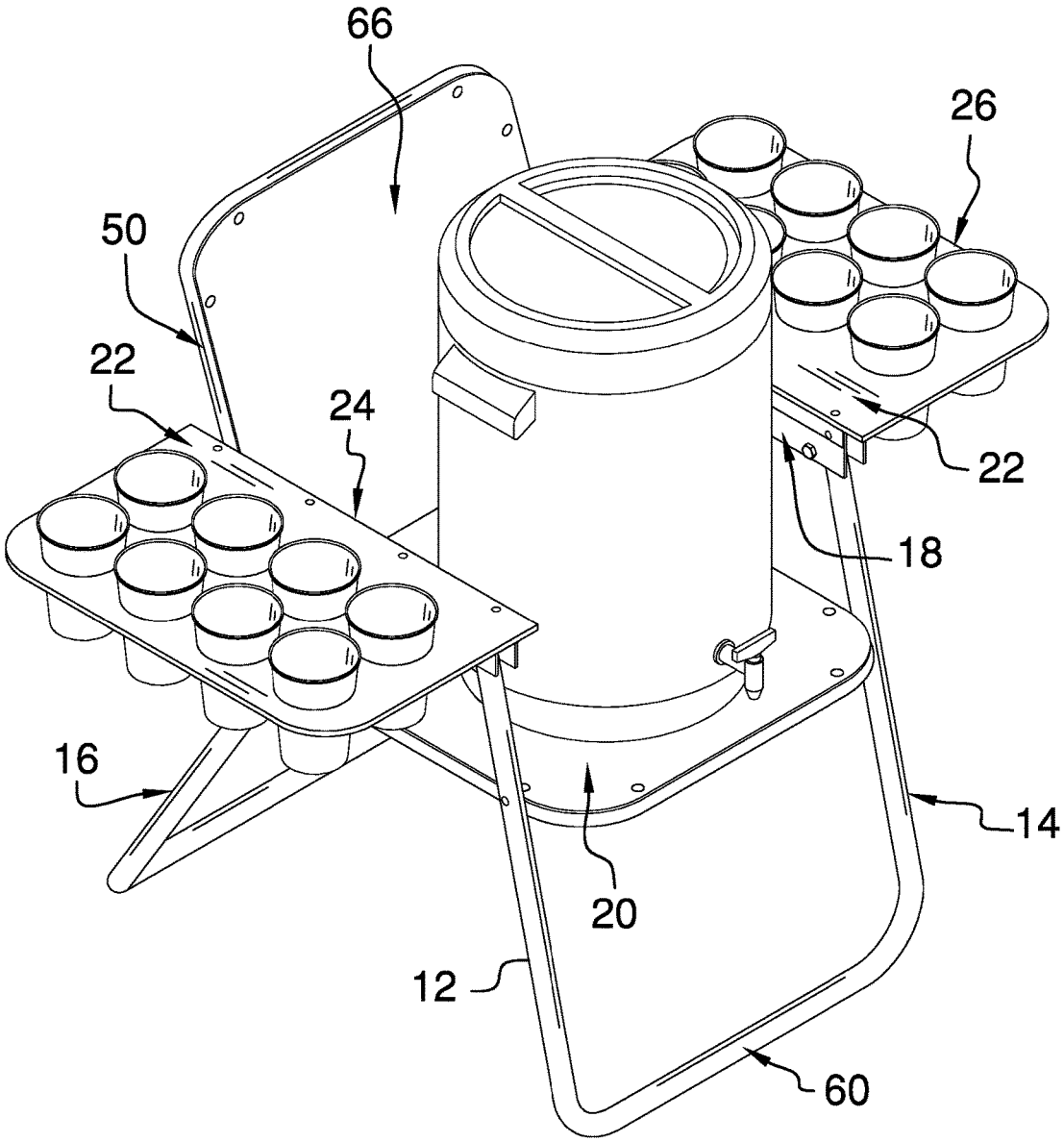
FIG. 5 is an in-use view of an embodiment of the disclosure.

With reference now to the drawings, and in particular to FIGS. 1 through 5 thereof, a new drink display device embodying the principles and concepts of an embodiment of the disclosure and generally designated by the reference numeral 10 will be described.

As best illustrated in FIGS. 1 through 5, the combination cooler support and drink display device 10 generally comprises a frame 12 that comprises a pair of front legs 14 and a pair of back legs 16. Each of a pair of beams 18 is pivotally coupled to a respective front leg 14 and a respective back leg 16. A platform 20, which is rigid, is pivotally coupled to each front leg 14 and each back leg 16. The frame 12 is foldable. The pair of beams 18 are coplanar and in substantial parallelism with the platform 20 when the frame 12 is in an unfolded position. Each of a pair of side tables 22 has an inner edge 24 hingedly coupled to a respective beam 18. Preferably, each side table 22 has an outer edge 26 that extends between a pair of rounded corners 28.

Each of a plurality of cup holders 30 is positioned in a respective side table 22. Preferably, the plurality of cup holders 30 comprises a plurality of penetrations 32, and each penetration 32 is circular. The plurality of cup holders 30 comprises from two to twenty cup holders in each side table 22. Preferably, the plurality of cup holders 30 comprises from four to eighteen cup holders in each side table 22. More preferably, the plurality of cup holders 30 comprises eight cup holders in each side table 22. Preferably, the cup holders 30 are positioned in a plurality of rows 34. More preferably, the plurality of rows 34 comprises two rows positioned in each of the side tables 22.

Preferably, each beam 18 is pivotally coupled to a respective top end 36 of a respective front leg 14 and a respective top end 14 of a respective back leg 16; such that the platform 20 is positioned between the top ends 14 and foot ends 38 of the front legs 14 and the back legs 16. Preferably, the platform 20 is substantially rectangular.

Each of a pair of pivot plates 40 has a bottom pivot hole 42 pivotally coupled to a respective back leg 16. Each pivot plate 40 has a center back pivot hole 44 pivotally coupled to a respective opposing edge 46 of the platform 20 proximate to a back edge 48 of the platform 20. Each of a pair of back supports 50 has a first end 52 that is pivotally coupled to a respective top pivot hole 54 of a respective pivot plate 40. Each back support 50 also is pivotally coupled to a respective beam 18 proximate to a respective opposing end 56 of the beam 18. The top ends 36 of the front legs 14 are pivotally coupled to respective opposing edges 46 of the platform 20 proximate to a front edge 58 of the platform 20. Each front leg 14 is pivotally coupled to a respective beam 18 proximate to a respective opposing end 56 of the respective beam 18. The top ends 36 of the back legs 16 are pivotally coupled to a respective beam 18 substantially equally distant from the opposing ends 56 of the beam 18. The top pivot hole 54, the bottom pivot hole 42 and the center back pivot hole 44 are positioned triagonally in the pivot plate 40.

The device 10 also may comprise a trio of cross supports 60. One of the trio of cross supports 60 is coupled to and extends perpendicularly between the pair of front legs 14. Another of the trio of cross supports 60 is coupled to and extends perpendicularly between the pair of back legs 16. The other of the trio of cross supports 60 is coupled to and extends perpendicularly between the pair of back supports 50. Preferably, one of the trio of cross supports 60 is coupled to and extends perpendicularly between the foot ends 38 of the pair of front legs 14, another of the trio of cross supports 60 is coupled to and extends perpendicularly between the foot ends 38 of the pair of back legs 16, and the other of the trio of cross supports 60 is coupled to and extends perpendicularly between upper ends 62 of the pair of back supports 50. Preferably, the pair of front legs 14, the pair of back legs 16 and the trio of cross supports 60 comprise tubes 64 that are circular when viewed longitudinally.

Preferably, each back support 50 extends transversely from the respective beam 18, such that the upper end 62 of the back support 50 is positioned above the respective beam

18. A back 66, which is rigid and substantially planer, is coupled to and extends between the pair of back supports 50. The frame 12 is unfoldable to position the platform 20 to seat a user and the back 66 is configured to support the back of a user.

In use, the frame 12 is configured to be unfolded and positioned on a substantially horizontal surface, such that the platform 20 and the side tables 22 are substantially horizontal. The platform 20 is configured to support and position a cooler to dispense drinks into cups. The plurality of cup holders 30 is configured to store the cups prior to and after filling. The frame 12 is foldable to position the front legs 14 adjacent to and in substantial parallelism with the back legs 16. With the frame 12 folded, the beams 18 and the platform 20 also are positioned in substantial parallelism with the front legs 14, and the side tables 22 are foldable to a position adjacent to a rear side 28 of the back 66.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A combination cooler support and drink display device comprising:

a frame, said frame comprising a pair of front legs and a pair of back legs;

a pair of beams, each of said pair of beams being pivotally coupled to a respective said front leg and a respective said back leg, each said beam being pivotally coupled to a respective top end of a respective front leg and a respective top end of a respective back leg;

a platform, said platform being rigid, said platform being pivotally coupled to each of said front legs and each of said back legs such that said platform is positioned between said top ends and foot ends of said front legs and said back legs, wherein said frame is foldable and such that said pair of beams are coplanar and in substantial parallelism with said platform when said frame is in an unfolded position;

a pair of side tables, each said side table having an inner edge hingedly coupled to a respective said beam;

a plurality of cup holders, each said cup holder being positioned in a respective said side table, said cup holders being positioned in a plurality of rows, said plurality of rows comprising two rows positioned in each of said side tables;

wherein said platform is configured to support and position a cooler for dispensing drinks into cups, and wherein the plurality of cup holders is configured to store the cups prior to and after filling;

a pair of pivot plates;

each said pivot plate having a bottom pivot hole pivotally coupled to a respective said back leg; and each said pivot plate having a center back pivot hole pivotally coupled to a respective opposing edge of said platform proximate to a back edge of said platform.

2. The device of claim 1, further including each said side table having an outer edge extending between a pair of rounded corners.

3. The device of claim 1, further including said platform being substantially rectangular.

4. The device of claim 1, further including said plurality of cup holders comprising from four to eighteen cup holders in each said side table.

5. The device of claim 1, further including said plurality of cup holders comprising eight cup holders in each said side table.

6. The device of claim 1, further including said plurality of cup holders comprising a plurality of penetrations.

7. The device of claim 6, further including said penetrations being circular.

8. The device of claim 1, further comprising:

a pair of back supports, each said back support having a first end;

each said first end being pivotally coupled to a respective top pivot hole of a respective said pivot plate; and each said back support being pivotally coupled to a respective said beam proximate to a respective opposing end of said beam.

9. The device of claim 8, further comprising:

each said top end of said front legs being pivotally coupled to a respective said opposing edge of said platform proximate to a front edge of said platform;

each said front leg being pivotally coupled to a respective said beam proximate to a respective said opposing end of said respective beam; and each said top end of said back legs being pivotally coupled to a respective said beam substantially equally distant from said respective said opposing ends of said beam.

10. The device of claim 8, further including said top pivot hole, said bottom pivot hole and said center back pivot hole being positioned triagonally in said pivot plate.

11. The device of 8, further comprising:

each said back support extending transversely from said respective said beam, such that a respective upper end of each said back support is positioned above said respective said beam;

a back, said back being rigid and substantially planer, said back being coupled to and extending between said pair of back supports; and wherein said frame is unfoldable to position said platform to seat a user and said back is configured to support the back of a user, and wherein said side tables are foldable to a position adjacent to a rear side of said back when said frame is in a folded position.

12. The device of claim 8, further comprising:

a trio of cross supports;

one of said trio of cross supports being coupled to and extending perpendicularly between said front legs;

another of said trio of cross supports being coupled to and extending perpendicularly between said back legs; and the other of said trio of cross supports being coupled to and extending perpendicularly between said back supports.

13. The device of claim 12, further comprising:

one of said trio of cross supports being coupled to and extending perpendicularly between said foot ends of said front legs;

another of said trio of cross supports being coupled to and extending perpendicularly between said foot ends of said back legs; and the other of said trio of cross supports being coupled to and extending perpendicularly between upper ends of said back supports.

14. The device of claim 12, further including said front legs, said back legs and said cross supports comprising tubes, said tubes being circular when viewed longitudinally.

15. A combination cooler support and drink display device comprising:

a frame, said frame comprising a pair of front legs and a pair of back legs;

a pair of beams, each of said pair of beams being pivotally coupled to a respective said front leg and a respective said back leg;

a platform, said platform being rigid, said platform being pivotally coupled to each of said front legs and each of said back legs, wherein said frame is foldable and such that said pair of beams are coplanar and in substantial parallelism with said platform when said frame is in an unfolded position;

a pair of side tables, each said side table having an inner edge hingedly coupled to a respective said beam;

a plurality of cup holders, each said cup holder being positioned in a respective said side table;

each said beam being pivotally coupled to a respective top end of a respective front leg and a respective top end of a respective back leg; such that said platform is positioned between said top ends and foot ends of said front legs and said back legs;

said platform being rigid, said platform being substantially rectangular;

a pair of pivot plates, each said pivot plate having a bottom pivot hole pivotally coupled to a respective said back leg, each said pivot plate having a center back pivot hole pivotally coupled to a respective opposing edge of said platform proximate to a back edge of said platform;

a pair of back supports, each said back support having a first end, each said first end being pivotally coupled to a respective top pivot hole of a respective said pivot plate, each said back support being pivotally coupled to a respective said beam proximate to a respective opposing end of said beam;

each said top end of said front legs being pivotally coupled to a respective said opposing edge of said platform proximate to a front edge of said platform;

each said front leg being pivotally coupled to a respective said beam proximate to a respective said opposing end of said respective beam;

each said top end of said back legs being pivotally coupled to a respective said beam substantially equally distant from said respective said opposing ends of said beam;

said top pivot hole, said bottom pivot hole and said center back pivot hole being positioned triagonally in said pivot plate;

a trio of cross supports, one of said trio of cross supports being coupled to and extending perpendicularly between said pair of front legs, another of said trio of cross supports being coupled to and extending perpendicularly between said pair of back legs, the other of said trio of cross supports being coupled to and extending perpendicularly between said pair of back supports;

one of said trio of cross supports being coupled to and extending perpendicularly between said foot ends of said pair of front legs, another of said trio of cross supports being coupled to and extending perpendicularly between said foot ends of said pair of back legs, the other of said trio of cross supports being coupled to and extending perpendicularly between upper ends of said pair of back supports;

said pair of front legs, said pair of back legs and said trio of cross supports comprising tubes, said tubes being circular when viewed longitudinally;

each said side table having an outer edge extending between a pair of rounded corners;

each said back support extending transversely from said respective said beam, such that said upper end of said back support is positioned above said respective said beam;

a back, said back being rigid and substantially planer, said back being coupled to and extending between said pair of back supports, wherein said frame is unfoldable to position said platform to seat a user and said back is configured to support the back of a user;

said plurality of cup holders comprising a plurality of penetrations, said penetrations being circular, said plurality of cup holders comprising from two to twenty cup holders in each said side table, said plurality of cup holders comprising from four to eighteen cup holders in each said side table, said plurality of cup holders comprising eight cup holders in each said side table, said cup holders being positioned in a plurality of rows, said plurality of rows comprising two rows positioned in each of said side tables; and wherein said frame is configured to be unfolded and positioned on a substantially horizontal surface, such that said platform and said side tables are substantially horizontal, wherein said platform is configured to support and position a cooler for dispensing drinks into cups, wherein the plurality of cup holders is configured to store the cups prior to and after filling, wherein said frame is foldable to position said front legs adjacent to and in substantial parallelism with said back legs, wherein said beams and said platform also are positioned in substantial parallelism with said front legs, and wherein said side tables are foldable to a position adjacent to said rear side of said back when said frame is in a folded position.

* * * * *